US008770109B2

(12) United States Patent
Guth

(10) Patent No.: US 8,770,109 B2
(45) Date of Patent: Jul. 8, 2014

(54) FLARE WITH FLARE IGNITION AND EJECTOR MECHANISM FOR THE SAME

(75) Inventor: Sven Guth, Müllheim (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 0 days.

(21) Appl. No.: 12/970,585

(22) Filed: Dec. 16, 2010

(65) Prior Publication Data

US 2011/0146520 A1 Jun. 23, 2011

Related U.S. Application Data

(63) Continuation-in-part of application No. PCT/EP2009/004113, filed on Jun. 8, 2009.

(30) Foreign Application Priority Data

Jun. 16, 2008 (DE) ..... 10 2008 064 638

(51) Int. Cl.
*F42B 4/26* (2006.01)
*F42B 12/42* (2006.01)

(52) U.S. Cl.
USPC ..... 102/342; 102/336

(58) Field of Classification Search
USPC ..... 102/336, 342, 345, 351, 357
See application file for complete search history.

(56) References Cited

U.S. PATENT DOCUMENTS

| | | | |
|---|---|---|---|
| 2,678,603 | A | 5/1954 | Prince, Jr. et al. |
| 2,787,217 | A | 4/1957 | Mahaffie |
| 3,216,410 | A | 11/1965 | Trombatore et al. |
| 3,628,416 | A | 12/1971 | Kernan |
| 3,760,729 | A | 9/1973 | Freeman |
| 4,002,122 | A | 1/1977 | Gould |
| 4,060,435 | A | 11/1977 | Schroeder |
| 4,068,591 | A | 1/1978 | Betts |
| 4,096,804 | A | 6/1978 | Bilsbury |
| 4,374,494 | A | 2/1983 | Maury |
| 4,409,898 | A | 10/1983 | Blix et al. |
| 4,624,186 | A | 11/1986 | Widera et al. |
| 4,838,167 | A | 6/1989 | Prahauser et al. |
| H0000778 | H | 5/1990 | Carlton et al. |

(Continued)

FOREIGN PATENT DOCUMENTS

| | | | |
|---|---|---|---|
| CA | 2146015 | A1 | 2/1995 |
| DE | 649 530 | C | 8/1937 |

(Continued)

OTHER PUBLICATIONS

Written Opinion of the International Searching Authority (Translation) for PCT/EP2009/004113; Dec. 2011.*

(Continued)

*Primary Examiner* — James Bergin
(74) *Attorney, Agent, or Firm* — Griffin & Szipl, P.C.

(57) ABSTRACT

A flare ignition system for an ejectable flare (10), for protecting moving and/or stationary objects from heat-seeking threats, is disclosed, wherein the flare ignition system is characterized by a heat transfer occurring within a type of tube or tube nozzle (1) provided with one or more heating elements. The flare ignition system is integrated in an ejector system (2), which additionally comprises an accelerator unit (3) surrounding the tube nozzle (1) and a heat insulation (4) bound between the two.

19 Claims, 2 Drawing Sheets

(56) References Cited

U.S. PATENT DOCUMENTS

| | | | | |
|---|---|---|---|---|
| 5,074,216 | A | 12/1991 | Dunne et al. | |
| 5,635,666 | A | 6/1997 | Bannasch et al. | |
| 5,929,369 | A | 7/1999 | Bissig et al. | |
| 5,992,327 | A | 11/1999 | Wardecki et al. | |
| 6,055,909 | A | 5/2000 | Sweeny | |
| 6,427,599 | B1 | 8/2002 | Posson et al. | |
| 6,513,438 | B1 | 2/2003 | Fegg et al. | |
| 6,659,012 | B1 | 12/2003 | Grassl et al. | |
| 6,666,351 | B1 * | 12/2003 | Hartz et al. | 221/258 |
| 7,343,861 | B1 * | 3/2008 | Baker | 102/336 |
| 7,363,861 | B2 * | 4/2008 | Brune et al. | 102/342 |
| 7,421,950 | B2 | 9/2008 | Dillard et al. | |
| 7,516,700 | B1 | 4/2009 | Callaway | |
| 7,584,702 | B1 * | 9/2009 | Sutherland et al. | 102/363 |
| 7,866,265 | B1 | 1/2011 | Kravel et al. | |
| 7,992,496 | B2 | 8/2011 | Dillard et al. | |
| 8,146,504 | B2 | 4/2012 | Wallner et al. | |
| 8,276,518 | B2 | 10/2012 | Dillard et al. | |
| 2002/0011173 | A1 | 1/2002 | Schildknecht et al. | |
| 2003/0116050 | A1 | 6/2003 | Brum et al. | |
| 2004/0139876 | A1 | 7/2004 | Wilson et al. | |
| 2004/0244626 | A1 | 12/2004 | Ehmig | |
| 2006/0032391 | A1 | 2/2006 | Brune et al. | |
| 2006/0201372 | A1 | 9/2006 | Nicolae | |
| 2007/0039505 | A1 | 2/2007 | Dillard et al. | |
| 2009/0007768 | A1 | 1/2009 | Wallner et al. | |
| 2009/0095186 | A1 | 4/2009 | Dillard et al. | |
| 2009/0301336 | A1 | 12/2009 | Wardecki et al. | |
| 2010/0288111 | A1 | 11/2010 | Kunz | |
| 2011/0174182 | A1 | 7/2011 | Guth et al. | |
| 2012/0137913 | A1 | 6/2012 | Prelic et al. | |
| 2012/0160121 | A1 | 6/2012 | Prelic et al. | |

FOREIGN PATENT DOCUMENTS

| | | | |
|---|---|---|---|
| DE | 2359758 | C1 | 7/1988 |
| DE | 94 14 263 | U1 | 10/1994 |
| DE | 197 56 204 | C1 | 3/1999 |
| DE | 199 10 074 | A1 | 9/2000 |
| DE | 199 51 767 | A1 | 5/2001 |
| DE | 103 23 531 | B3 | 2/2005 |
| DE | 10 2005 020 159 | A1 | 11/2006 |
| DE | 10 2006 004 912 | A1 | 7/2007 |
| DE | 196 49 892 | A1 | 7/2008 |
| DE | 10 2007 032 112 | A1 | 1/2009 |
| DE | 102009020558 | A1 | 11/2010 |
| DE | 10 2009 030 868 | A1 | 1/2011 |
| EP | 0 204 115 | A2 | 12/1986 |
| FR | 715 614 | A | 12/1931 |
| GB | 250 271 | A | 10/1926 |
| JP | 11173796 | A | 7/1999 |
| WO | 00/19164 | A1 | 4/2000 |
| WO | 2007/087948 | A1 | 8/2007 |
| WO | 2010/003496 | A1 | 1/2010 |
| WO | 2010/019291 | A1 | 12/2010 |

OTHER PUBLICATIONS

International Search Report issued in International Application No. PCT/EP2009/004113, completed Sep. 29, 2009, mailed Oct. 6, 2009.

International Search Report issued in International Application No. PCT/EP2009/004114, completed Oct. 1, 2009, mailed Oct. 13, 2009.

Office Action issued in co-pending related application 12/969,253 on Jan. 15, 2013.

"Stainless Steels," at http://www.dew-stahl.com/fileadmin/files/dew-stahl.com/documents/Publikationen/Broschueren/015_DEW_RSH_GB.pdf (downloaded Dec. 2, 2013).

Office Action issued in co-pending related application 13/291,281 on Sep. 5, 2013.

Mcgraw-Hill Dictionary of Scientific and Technical Terms (Sixth Ed.) 814 (2003).

"United States Naval Pyrotechnical Compositions," at http://www.google.com/urlsa=t&rct=j&q=&esrc=s&source=web&cd=9&ved=0CGYQFjAI&url=http%3A%2F%2Fwww.am-munitionpages.com%2Fdownload%2F237%2FUS%2520navy%2520pyrotechnicspdf&ei=zjI6UsagMLXi4AOnw4Fw&usg=AFQjCNGhmQURaXkLjZAol124l0jajOvmlg&sig2=vw04ff4-VMe_PYiiD8aZzw&bvm=bv.52434380,d.dmg (downloaded Sep. 18, 2013, five pages).

S.M. Danali et al., Developments in Pyrotechnics, 60 Defense Science Journal 152-158 (2010).

Clarence W. Gilliam et al., Flare, Igniter and Pyrotechnic Disposal: Red Phosphorous Smokes, Naval Ammunition Depot, AD-A013 182 (1975).

"Pyrotechnic Chemistry," at http://www.islandgroup.com/military/pyrotechnic_chemistry.php (2013)(downloaded Sep. 18, 2013, two pages).

Charles A. Knapp, New Infrared Flare and High-altitude Igniter Compositions, Feltman Research and Engineering Laboratories, Picatany Arsenal (1959).

Rui Shu, Explosive Chemistry: The History and Chemistry of Explosives, Dartmouth Undergraduate Journal of Science 21-23 (2012).

Gao Guangyan, Nitrocellulose Synthesis Outline, at http://www.loneoceans.com/labs/nitrocellulose/ (2012).

Random House Webster'S College Dictionary 506 (1991).

English translation (Jan. 2012) of the Written Opinion of the International Searching Authority in PCT/EP2010/003565.

International Search Report issued in related application PCT/EP2010/002332, completed Jun. 29, 2010 and mailed Jul. 6, 2010.

International Search Report and IPRP issued in PCT/EP2010/003565, completed Aug. 31, 2010 and mailed Sep. 7, 2010.

International Search Report and IPRP issued in PCT/EP2010/003566, completed Aug. 27, 2010 and mailed Sep. 7, 2010.

International Search Report and IPRP issued in PCT/EP2010/003567, completed Sep. 16, 2010 and mailed Sep. 22, 2010.

Notice of Allowance issued in co-pending related application 13/380,959 on Nov. 26, 2013.

* cited by examiner

FLARE WITH FLARE IGNITION AND EJECTOR MECHANISM FOR THE SAME

This is a Continuation-in-Part Application in the United States of International Patent Application No. PCT/EP2009/004113 filed Jun. 8, 2009, which claims priority on German Patent Application No. 10 2008 064 638.5, filed Jun. 16, 2008. The entire disclosures of the above patent applications are hereby incorporated by reference.

FIELD OF THE INVENTION

The invention relates to a flare and to the capability for improved flare ignition. In particular, the invention relates to a flare provided with novel and rapid ignition of coated films with active pyrotechnic substances for the production of a pyrotechnic signature with the aim of producing a camouflage screen etc., for the protection of vehicles and objects, for example, aircraft against heat-seeking threats, for example, surface-to-air rockets.

BACKGROUND OF THE INVENTION

Pyrotechnic films provided with a pyrotechnic coating, for example red phosphorus, are used in various cartridges, in order to spontaneously cover a surface with hot particles in order, for example, to mask out a thermal image. In this case, the carrier is broken up with the aid of a central fuse charge. During break up, a flame front and a pressure front are formed, which, on the one hand, distribute the pyrotechnic films over an area, and, on the other hand, produce a flame front, thereby igniting the pyrotechnic films.

At the moment, Class 1 break-up systems are used to produce these massive pyrotechnic effects. This results in a very high classification of the active system and prevents use for protection, for example, of civilian aircraft, because it is forbidden to carry Class 1 substances/appliances in aircraft such as civilian aircraft.

The purpose for the present invention, in this context, is to provide a flare having a flare ignition that also allows use of the flare for/in civilian aircraft, vehicles, objects, etc. In other words, an object of the present invention is to provide a flare that has a flare ignition system that permits its use for civilian purposes (i.e., with civilian aircraft, civilian vehicles, and the like), and that is not limited to use with military aircraft, vehicles, and the like.

SUMMARY OF THE INVENTION

The object of the invention is achieved by the features of a first embodiment, which pertains to a flare (10) for the production of a pyrotechnic signature with the aim of producing a camouflage screen etc., for the protection of vehicles and objects, the flare (10) is characterized in that the flare (10) is polygonal and coated, with the number of corners (E) being greater than three. Further advantages are achieved by the following additional embodiments, in accordance with the present invention.

In accordance with a second embodiment of the present invention, the flare ignition for the ejectable flare (10) according to the first embodiment is modified so that contactless igniting is carried out by heat transfer within a type of tube or tubular connecting stub (1) with heating elements, wherein the tubular connecting stub (1) has a conically tapering shape. In accordance with a third embodiment of the present invention, the second embodiment is modified so that the tubular connecting stub (1) can be heated electrically and by a burner.

In accordance with a fourth embodiment of the present invention, an ejection system (2) having flare ignition is provided, wherein the flare ignition is that provided by the second embodiment or the third embodiment, which is further characterized by an acceleration unit (3), which is disposed adjacent to the tube (1) and the heat decoupling (4), wherein the heat decoupling (4) is located between the acceleration unit (3) and the tube (1). In accordance with a fifth embodiment of the present invention, the fourth embodiment is modified so that the diagonal ($D_F$) between the corners (E) of the flare (10) is greater than the front internal diameter ($D_{IR-2}$) but is less than or equal to the rear internal diameter ($D_{IR-1}$) of the tubular connecting stub (1). In accordance with a sixth embodiment of the present invention, the fourth embodiment and the fifth embodiment are further modified so that the flares (10) can be accelerated mechanically, pneumatically or pyrotechnically.

The present invention is based on the idea of achieving the ignition of the flare contactlessly, for example, by heat transfer. To this end, a specific temperature that is higher than the ignition temperature of pyrotechnic films coating the flare is produced and is transmitted to the pyrotechnic films, so that they are ignited by the heat transfer.

This ignited flare is then carried out from the interior of the tubular connecting stub 1 so that the ignited flare is ejected by the ejection system 2 as the flare moves in the axial direction.

The solution principle is represented by a tubular connecting stub, which can be heated to the specific temperature and, preferably, tapers conically, by means of which the films, provided with a pyrotechnic or comparable coating that can be ignited, are ignited during axial relative movement. The coated films are ignited in the tubular connecting stub and travel inside the tubular connecting stub while burning until the ignited flare is ejected by a flare ejection system.

When the coated polygonal films move relatively in the heated tubular connecting stub, their corners slide along the connecting stub length and are ignited by the heat transfer produced in the corners that are in contact with the tube or tubular connecting stub.

The tapering barrel is, therefore, one preferred embodiment to ensure ignition. The contact surface between the coated film and the (conical) tubular connecting stub increases continuously during relative movement, and, as a consequence, increases the functional reliability of the ignition mechanism.

The heating of the (conical) tubular connecting stub can be carried out both electrically (i.e., by electrical heating elements) and by a burner, etc. An advantage provided by the present invention is that the active signature of the flare starts without delay of ejection of the burning coated films of the flare, and enhances the effectiveness of the protection system.

The coated films preferably have a specific polygonal geometry. The functional reliability of the ignition mechanism is, in this case, increased in proportion to the number of corners of the coated films of the flare.

The coated films can be deployed individually, and in layers in a pack; thus, considerably enhancing the effectiveness of the protection system. Radial rotation of the coated film is irrelevant to the effectiveness itself of the ignition system of the present invention.

The advantages of this ignition system are not only the very high functional reliability with a low failure rate, but little maintenance effort, low costs and adequate safety for transport and when in operation. This is achieved because the coated films are accelerated in a separate acceleration system, which is at the same time decoupled from the heat, before the heated tube or tubular connecting stub. The coated films can be accelerated mechanically (for example, by a spindle drive of the acceleration unit of the flare deployment system), pneumatically (for example, by compressed air from a pneumatic system of the acceleration unit of the flare deployment system), or else pyrotechnically (e.g., by using a pyrotechnic mechanism).

The ignition system of the present invention is suitable not only for protection of civilian aircraft but also for protection of vehicles, buildings, moving and/or stationary objects of any type (i.e., civilian or military), and of marine vessels because of the characteristics of the flares, which provide visual (smoke) and infrared concealment.

BRIEF DESCRIPTION OF THE DRAWINGS

The present invention will be explained in more detail using one exemplary embodiment, and with reference to the drawings, in which.

DETAILED DESCRIPTION OF THE INVENTION

Figure 1:
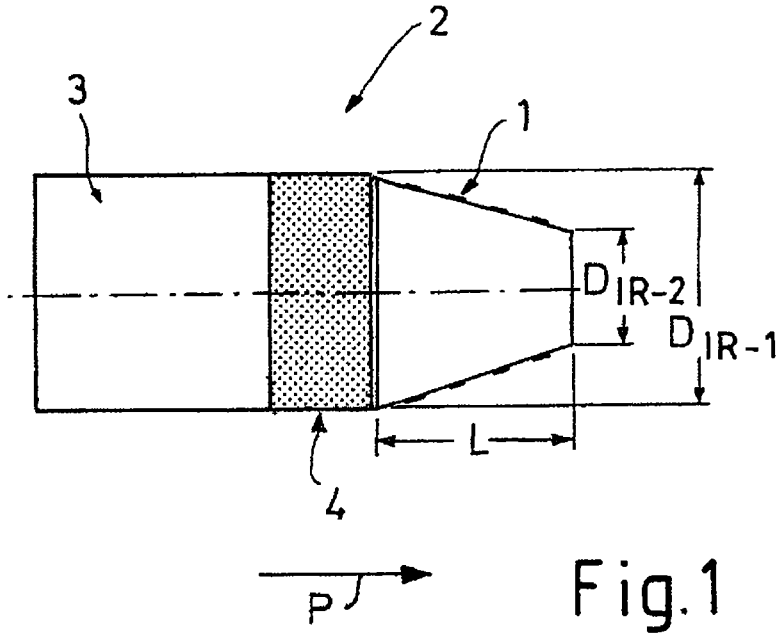
FIG. 1 shows a cross-sectional, schematic view of a conically tapering tubular connecting stub as the basic unit for ignition as part of a flare ejection system.
Figure 2:
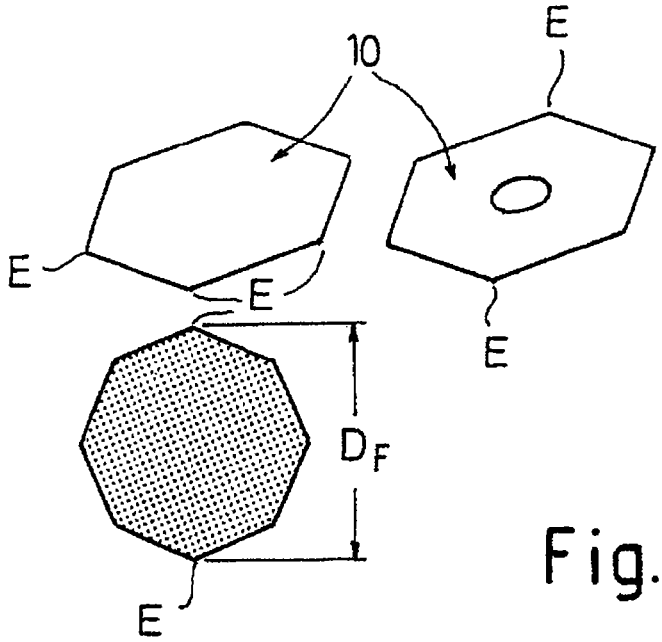
FIG. 2 shows a geometrically preferred illustration of a flare.

In FIG. 1, 1 denotes a preferably conically tapering tubular connecting stub operably associated with a heating element of a flare deployment system 2 (also referred to as a "flare ejection system") for at least one flare 10 (See FIG. 2). The tubular connecting stub 1 has a first, front internal diameter $D_{IR-2}$ and a second, rear internal diameter $D_{IR-1}$, as well as a length L. The deployment system 2 furthermore comprises an acceleration unit 3 and insulation 4 in order to provide thermal decoupling between the ignition unit 1 and the acceleration unit 3. The second internal diameter $D_{IR-1}$ is, in this case, equal to the diameter of the insulation 4 and of the acceleration unit 3. P denotes, in FIG. 1, the axial movement direction of the film and of the flare 10.

FIG. 2 shows a polygonal, coated flare 10. The number of corners E of the flare 10 should be greater than three. The diagonal $D_F$ between the corners E is, in this case, greater than the front internal diameter $D_{IR-2}$. The rear internal diameter $D_{IR-1}$ is itself greater than or equal to the diagonals $D_F$. During relative movement—in the direction P—of the flare 10 inside the conically tapering tubular connecting stub 1, the corners E of the flare 10 slide in the heated tube 1 along the length L and are ignited by the heat transfer that is produced in the corners E, which are in contact with the tubular connecting stub 1 so that heat is transferred from the heated tube 1 to the corners E of the flare 10. Subject to the condition mentioned above, the contact area for heat transfer between the coated film coating the flare 10 and the correspondingly conical tubular connecting stub 1 increases continuously during relative movement.

Figure 3:
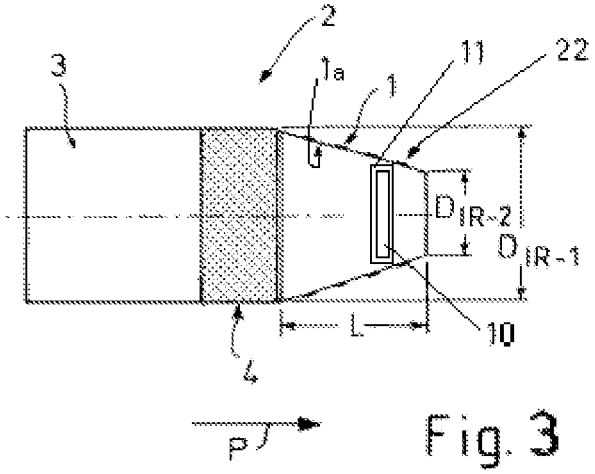
FIG. 3 shows a cross-sectional, schematic view of a flare disposed inside the conically tapering tubular connecting stub of the flare ignition system of the present invention and prior to ejection by the flare ejection system.

In sum then, the ignition system of the present invention includes a heating element 22 of the deployment system 2, wherein the heating element is a burner or an electrical device (See FIG. 3). The heating element is disposed and/or connected to the tube 1 so as to heat the tube. Thus, the tube 1 is also part of the ignition system of the invention. A flare 10 is disposed inside the tube 1, as shown in FIG. 3, and the flare 10 is provided with a pyrotechnic coating 11. As the flare 10 moves in direction P inside the tube 1, more of the pyrotechnic coating 11 on the surface of the flare 10 comes in contact with the inside wall 1*a* of the tube 1. In the alternative, for contactless ignition, the pyrotechnic coating 11 on the surface of the flare 10 approaches close to the inside wall 1*a* of the tube 1. Consequently, as more surface of the pyrotechnic coating 11 comes into contact with the heated inner wall 1*a* of the tube 1, or just comes into close proximity to the heated inner wall 1*a* of tube 1, heat transfer from the heated tube 1 to the pyrotechnic coating 11 increases, thereby igniting the pyrotechnic film 11 of the flare 10. In this manner, the ignition system of the present invention ignites the flare 10 by heat transfer. The ignited flare 10 then continues moving along axial direction P and is ejected from an open end of the tube 1 by operation of the ejection system 2.

The ignition system of the present invention operates in a manner similar to the ignition system disclosed by DE 10 2009 020 558 A1, and its corresponding U.S. patent application Ser. No. 12/969,253, filed Dec. 15, 2010 (which has published as U.S. Patent Application Publication No. US 2011/0174182 A1). Both DE 10 2009 020 558 A1 and U.S. patent application Ser. No. 12/969,253 are incorporated herein by reference for all they disclose, as is U.S. Patent Application Publication No. US 2011/0174182 A1.

The described exemplary embodiment is one preferred embodiment. Alternatively, the heatable tubular connecting stub may also have a constant internal diameter. Conditions can then be created that allow adequate ignition of the flare 10, which can be achieved, for example, by the configuration of the flare 10 such that it should then be considerably larger than the internal diameter of the tubular connecting stub, in order that the corners of the flare can thus also come into contact with the heatable inner wall 1*a* of the tube. In order to ensure adequate ignition, the films 11 could, for example, have corners that can be bent over, via which the heat transfer then likewise takes place, when the film is accelerated along the inner wall of the tube or tubular connecting stub.

The invention claimed is:

1. An ejection system comprising:

(A) a flare ignition system comprising i. a tubular connecting stub provided with one or more heating elements disposed to heat the tubular connecting stub, wherein the tubular connecting stub has a conically tapering shape, wherein contactless ignition of an ejectable flare occurs due to heat transfer from the tubular connecting stub to a pyrotechnic film of the flare when the tubular connecting stub is heated by the one or more heating elements and when the flare is disposed along an inner wall of the tubular connecting stub, wherein the flare is polygonal in shape and comprises corners, wherein the number of corners is greater than three, and the flare is coated with the pyrotechnic film, wherein when ignited, the flare produces a pyrotechnic signature suitable for producing a camouflage screen for the protection of vehicles and objects;

(B) an acceleration unit that is disposed adjacent to the tubular connecting stub of the flare ignition system; and (C) a heat decoupling that is located between the acceleration unit and the tubular connecting stub.

2. The ejection system as claimed in claim 1, wherein the tubular connecting stub has a rear internal diameter ($D_{IR-1}$) and a front internal diameter ($D_{IR-2}$), wherein a diagonal ($D_F$) between corners of the flare is greater than the front internal diameter ($D_{IR-2}$) but is less than or equal to the rear internal diameter ($D_{IR-1}$) of the tubular connecting stub.

3. The ejection system as claimed in claim 2, wherein the flare is accelerated by the acceleration unit either mechanically, or pneumatically, or pyrotechnically.

4. The ejection system as claimed in claim 3, wherein the acceleration unit comprises a spindle drive, and the flare is mechanically accelerated by the spindle drive of the acceleration unit.

5. The ejection system as claimed in claim 3, wherein the acceleration unit comprises a pneumatic system, and the flare is pneumatically accelerated by the pneumatic system of the acceleration unit.

6. The ejection system as claimed in claim 1, wherein the flare is accelerated by the acceleration unit either mechanically, or pneumatically, or pyrotechnically.

7. The ejection system as claimed in claim 6, wherein the acceleration unit comprises a spindle drive, and the flare is mechanically accelerated by the spindle drive of the acceleration unit.

8. The ejection system as claimed in claim 6, wherein the acceleration unit comprises a pneumatic system, and the flare is pneumatically accelerated by the pneumatic system of the acceleration unit.

9. The ejection system as claimed in claim 1, wherein the heat decoupling comprises insulation.

10. An ejection system comprising:

(A) a flare ignition system constructed to eject an ejectable flare that produces a pyrotechnic signature with the aim of producing a camouflage screen for the protection of vehicles and objects, wherein the flare is polygonal in shape and comprises corners, wherein the number of corners is greater than three, and the flare is coated with a pyrotechnic film, and wherein the flare ignition system comprises i. a tubular connecting stub provided with one or more heating elements disposed to heat the tubular connecting stub, wherein the tubular connecting stub has a conically tapering shape, wherein contactless ignition of the flare occurs due to heat transfer from the tubular connecting stub to the pyrotechnic film of the flare when the tubular connecting stub is heated by the one or more heating elements and when the flare is disposed along an inner wall of the tubular connecting stub, and wherein the one or more heating elements are selected from the group consisting of electrical heating elements and a burner;

(B) an acceleration unit that is disposed adjacent to the tubular connecting stub of the flare ignition system; and (C) a heat decoupling that is located between the acceleration unit and the tubular connecting stub.

11. The ejection system as claimed in claim 10, wherein the tubular connecting stub has a rear internal diameter ($D_{IR-1}$) and a front internal diameter ($D_{IR-2}$), wherein a diagonal ($D_F$) between corners of the flare is greater than the front internal diameter ($D_{IR-2}$) but is less than or equal to the rear internal diameter ($D_{IR-1}$) of the tubular connecting stub.

12. The ejection system as claimed in claim 11, wherein the flare is accelerated by the acceleration unit either mechanically, or pneumatically, or pyrotechnically.

13. The ejection system as claimed in claim 12, wherein the acceleration unit comprises a spindle drive, and the flare is mechanically accelerated by the spindle drive of the acceleration unit.

14. The ejection system as claimed in claim 12, wherein the acceleration unit comprises a pneumatic system, and the flare is pneumatically accelerated by the pneumatic system of the acceleration unit.

15. The ejection system as claimed in claim 10, wherein the flare is accelerated by the acceleration unit either mechanically, or pneumatically, or pyrotechnically.

16. The ejection system as claimed in claim 15, wherein the acceleration unit comprises a spindle drive, and the flare is mechanically accelerated by the spindle drive of the acceleration unit.

17. The ejection system as claimed in claim 15, wherein the acceleration unit comprises a pneumatic system, and the flare is pneumatically accelerated by the pneumatic system of the acceleration unit.

18. The ejection system as claimed in claim 10, wherein the heat decoupling comprises insulation.

19. An ejection system comprising:

(A) at least one ejectable flare, wherein the flare is polygonal in shape and includes corners, wherein the number of corners is greater than three, and the flare is coated with a pyrotechnic film;

(B) a flare ignition system comprising i. a tubular connecting stub provided with one or more heating elements disposed to heat the tubular connecting stub, wherein the tubular connecting stub has a conically tapering shape, wherein contactless ignition of the ejectable flare occurs due to heat transfer from the tubular connecting stub to the pyrotechnic film of the flare when the tubular connecting stub is heated by the one or more heating elements and when the flare is disposed along an inner wall of the tubular connecting stub, wherein when ignited, the flare produces a pyrotechnic signature suitable for producing a camouflage screen for the protection of vehicles and objects;

(C) an acceleration unit that is disposed adjacent to the tubular connecting stub of the flare ignition system; and (D) a heat decoupling that is located between the acceleration unit and the tubular connecting stub, wherein the heat decoupling comprises insulation, wherein the tubular connecting stub has a rear internal diameter ($D_{IR-1}$) and a front internal diameter ($D_{IR-2}$), wherein a diagonal ($D_F$) between corners of the flare is greater than the front internal diameter ($D_{IR-2}$) but is less than or equal to the rear internal diameter ($D_{IR-1}$) of the tubular connecting stub, and the one or more heating elements are selected from the group consisting of electrical heating element and a burner, and wherein the flare is accelerated by the acceleration unit either mechanically, or pneumatically, or pyrotechnically.

* * * * *